United States Patent [19]

Giulie

[11] Patent Number: 4,813,836

[45] Date of Patent: Mar. 21, 1989

[54] STRIP BINDER

[76] Inventor: Joe D. Giulie, 1086 E. Meadow Cir., Palo Alto, Calif. 94303

[21] Appl. No.: 105,248

[22] Filed: Oct. 6, 1987

Related U.S. Application Data

[63] Continuation-in-part of Ser. No. 868,275, May 29, 1986, abandoned.

[51] Int. Cl.[4] ..... B42C 1/00; B42F 13/00

[52] U.S. Cl. ..... 412/43; 402/60

[58] Field of Search ..... 412/6, 7, 38, 43; 402/60, 61, 63, 68, 69; 40/120

[56] References Cited

U.S. PATENT DOCUMENTS

| | | | |
|---|---|---|---|
| 3,689,185 | 9/1972 | Deman | 412/43 |
| 3,728,751 | 4/1973 | Nes | 412/43 |
| 3,879,783 | 4/1975 | Giulie | 412/43 |
| 3,994,035 | 11/1976 | Elder et al. | 412/43 |
| 4,270,970 | 6/1981 | Szanto et al. | 412/43 |
| 4,369,013 | 1/1983 | Abildgaard et al. | 412/43 |

*Primary Examiner*—Paul A. Bell

*Assistant Examiner*—Heyrana, Jr.: Paul M.

[57] ABSTRACT

A strip binding system is provided wherein the elements to be bound are held in compression by pulling from below so that no binding bar is required. The binding posts are of a thermoplastic material but the binding strips themselves can be of a different plastic.

5 Claims, 4 Drawing Sheets

STRIP BINDER

CROSS-REFERENCE TO RELATED APPLICATION

This is a continuation-in-part of application Ser. No. 868,275 filed May 29, 1986 entitled STRIP BINDER, abandoned Apr. 18, 1988.

SUMMARY OF THE INVENTION

Hot melt binding devices are known wherein a male binding strip having a plurality of thermoplastic studs is employed with a female binding strip, wherein the parts are pressed together and rivet heads are formed by heating the tips of the studs, forming a bound book. Such devices, as have been used in the past, have required a heavy superstructure including a binding bar which presses the parts together and holds them while the studs are cut and/or formed into rivet heads.

The present invention does not require any such binding bar or superstructure and can be in the form of a flat platen wherein the material to be bound is merely placed on the platen with the studs extending through holes, so that all of the compressing and binding action takes place beneath the flat platen. Thus, there are no upstanding parts and no possiblity of catching fingers or the like in a binding bar.

The hot melt binding systems used in the past have utilized thermoplastic binding strips wherein the studs are cast integral with the male binding strip. In accordance with the present invention, the binding strips can be made with separate parts wherein only the studs need be made of a thermoplastic material. Thus, the backing strips can be made of a relatively inexpensive material or even cardboard since strength is needed only in the immediate vicinity of the studs and the balance of the binding strip serves primarily a decorative purpose. Thus, the present invention enables one to use less expensive materials than have heretofore been known.

Further, if the studs are separate, the binding strips can be identical so it is not necessary to mold and stock two types of strips.

Other features and objects of the invention will be brought out in the balance of the specification.

DESCRIPTION OF THE PREFERRED EMBODIMENTS

Figure 1:
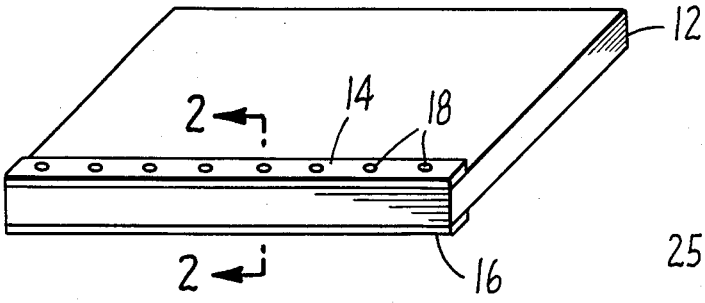
FIG. 1 is a perspective view of a sheaf of papers bound in accordance present invention.
Figure 2:
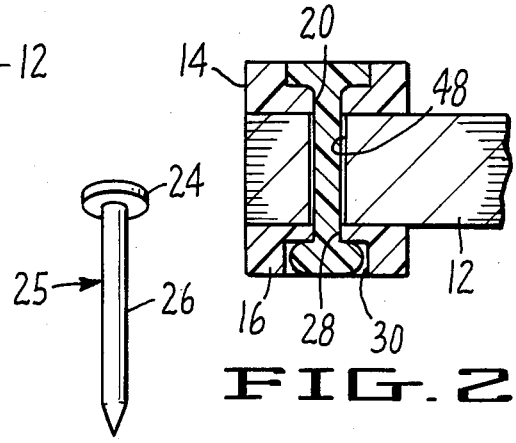
FIG. 2 is an enlarged section on the line 2—2 of FIG. 1.

Referring to the drawings now by reference characters, there is shown a sheaf of paper 12 bound at one edge with an upper binding strip 14 and a lower binding strip 16 with a plurality of studs 18 holding the strips in binding relationship. Upper binding strip 14 has a plurality of holes formed at regular intervals therealong. Each of the holes 20 is countersunk as at 22 to receive the head 24 of a stud 25 having a shank 26. The bottom strip 16 has a mating series of holes 28 and each of these is countersunk as at 30. It will be understood that the studs themselves must be of a thermoplastic material, but the strips 14 and 16 can be of a different type of plastic and can even be made of cardboard. Further, if individual studs are used, the upper and lower strips can be identical. Of course, it is also possible to utilize a male strip having a plurality of studs which are formed integral with the binding strip, in which case the entire structure would, of course, be made of a thermoplastic material.

The machine of the present invention employs a knife means 50 which can be heated by any suitable means such as by passing a current therethrough by means of the transformer 34. The knife means 50 has a plurality of holes therein corresponding in number and placement to the number of holes in the binding strips and each of these holes is of "keyhole" shape. Thus, each hole has a circular portion 60 and an elongated portion 70. Means are provided for moving the knife means 50 back and forth in the direction shown by the arrows 38. Mounted below the knife means 50 is a gripper plate 40 having a plurality of paired gripper elements 42 and 44 thereon which have teeth 46 adapted to move in and grip the post and pull it downwardly. Of course, the gripper elements again correspond in number and placement to the holes in the binding strip.

The sheaf of papers 12, which is to be bound, is provided with holes 48 along one edge, again corresponding in number and placement to the number of holes in the binding strips.

Figures 4, 5, 6, 7, 7A, 8, 9, 9A, 10, 11:
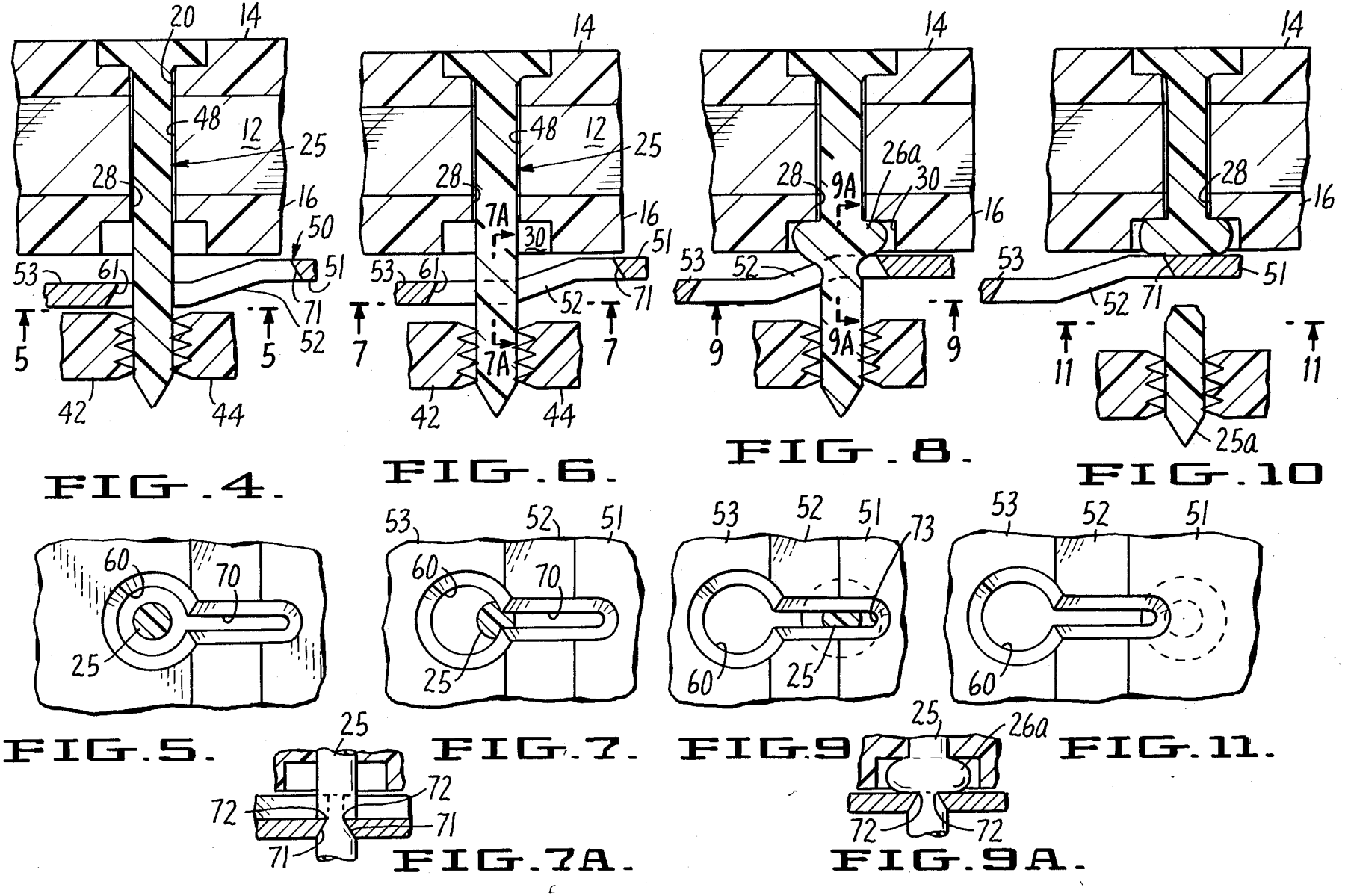
FIG. 4 is a section through a post at the beginning of a binding operation showing the start of the pulling action when the parts are pulled together in a compressed relationship.
FIG. 5 is a view on the line 5—5 FIG. 4.
FIG. 6 is a section through a post showing the beginning of the heading of the post.
FIG. 7 is a section on the line 7—7 of FIG. 6.
FIG. 7A is a section on the line 7A—7A of FIG. 6
FIG. 8 is a section through a post showing the parts in the position for the formation of a rivet head on the shank of a thermoplastic post.
FIG. 9 is a section on the line 9—9 of FIG. 8.
FIG. 9A is a section on the line 9A—9A of FIG. 8.
FIG. 10 shows the position of the parts at the completion of a binding operation.
FIG. 11 is a section on the line 11—11 of FIG. 10.
Figure 12:
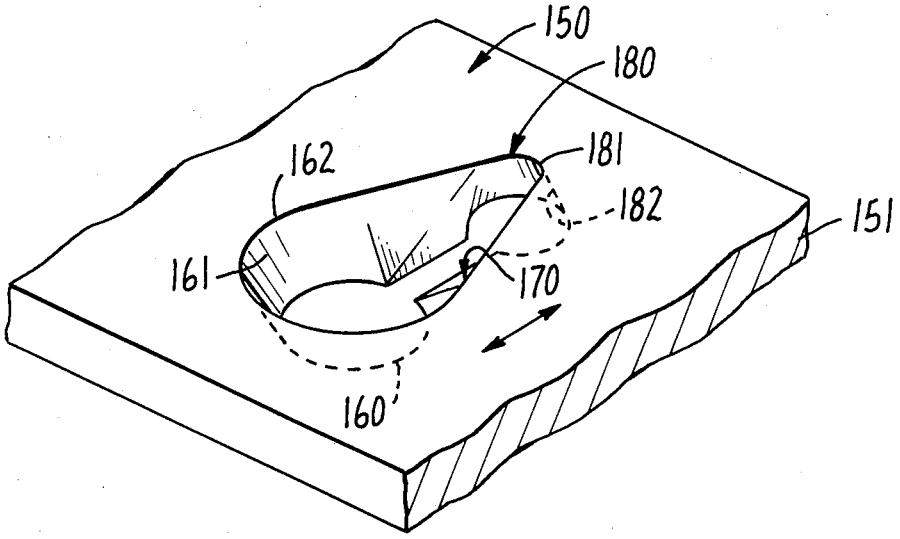
FIG. 12 is a perspective view of an alternate heading means and knife means which may be used in the invention.

The exact sequence of operations can best be understood by reference to FIGS. 4–11. In FIGS. 4 and 5, the sheaf of papers 12 has been placed between the binding strips 14 and 16 and the studs 25 are passed down through the holes 20 in the upper binding strip and the holes 48 in the sheaf of paper and out through the holes 28 in the lower binding strip 16. The gripper elements 42 and 44 have engaged the lower ends of studs 25 and are compressing the sheaf of paper 12. The gripper plate is pulled downward on the stud 25, compressing the sheaf of papers 12 between strips 14 and 16.

Figure 3:
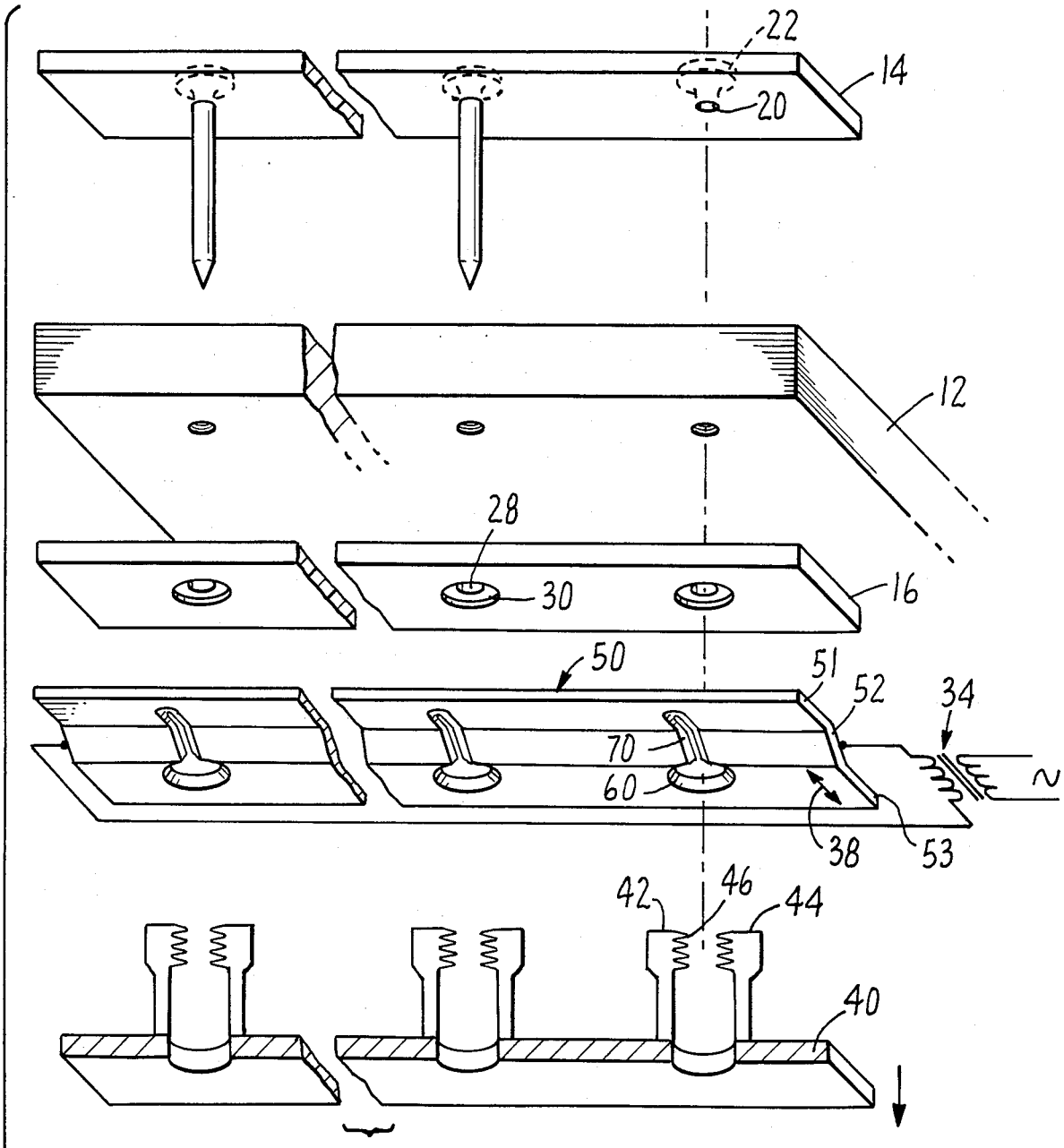
FIG. 3 is an exploded view illustrating the binding apparatus and process.

As shown in FIGS. 4 through 11, as well as in FIG. 3, knife means 50 has a horizontal upper section 51, a horizontal lower section 53 and an inclined intermediate section 52. Knife means 50 has formed therein a plurality of "keyhole" shaped holes wherein each hole has a circular portion 60 and an elongated portion 70. As used herein, the term "keyhole" shaped is used in a broad sense; the term includes any shape having an opening at one end large enough to allow clearance between the opening and the stud; and having a second portion with a shape to cause interference with the shank of the studs. For example, one end could be a semi-circle, and the other end a V-shaped taper from the semi-circle to a rounded point at the vertex of the V, as shown generally in FIG. 24. The edge of the elongated portion 70 is tapered as shown at 71 in FIG. 4. This tapered surface 71 is also shown in FIG. 7A, at which point knife means 50 has started to engage stud 25.

The overall purpose of the motion of knife means 50 is to both "head" the stud 25 (as shown in FIG. 8) and thereafter to sever the end of stud 25 (FIG. 10). Knife means 50 is an elongated plate with an upper, horizontal section 51, an inclined intermediate section 52, and a lower horizontal section 53. The circular portion 60 of the keyhole shaped opening in knife means 50 lies in lower plate section 53. The elongated portion 70 of the opening lies in the inclined plate section 52 and the upper plate section 51 of knife means 50. The edges of openings 60 and 70 form tapered surfaces 61 and 71, respectively, which converge in an upward direction, shown in FIG. 7A, terminating in sharp edges 62 and 72. Blade means 50 is heated and, as it moves to the left in FIGS. 4, 6 and 8, the upper, sharp edges 72 cut into the shank 26 of stud 25 and, as shown in FIG. 8, these sharp edges 72 "head" a portion of the shank 26 as the inclined portion 52 engages shank 26. The bulge **26*a* forms within countersunk portion 30 of strip 16 (FIG. 8). As shown in FIG. 10, the lower portion of stud 25 is severed by the sharp upper edge 73 at the end of elongated slot 70. "Heading means" refers to the edges 72 of elongated slot 70 which are oriented along an inclined path defined by the upper surface of inclined section 52 of knife means 50**.

As is shown in FIGS. 8 and 9, it will be seen that the center portion of the post is still intact, despite the fact that a portion of the post has melted to form the bulge **26*a***. It is surprising that one can melt a portion of the post, forming the enlarged rivet head yet leaving enough of the post intact so that pressure is maintained on the sheaf of paper.

FIGS. 12–18 show an alternate knife means 150, which is a flat plate 151 with a plurality of keyhole shaped openings formed therein, each having a circular portion 160, an elongated portion 170 and a cutoff portion 180.

The sidewall 161 of opening 160 is tapered with surfaces that diverge in the upward direction, so that the opening 162 is larger on the top of plate 151 than at the bottom of plate 151.

Figure 16:
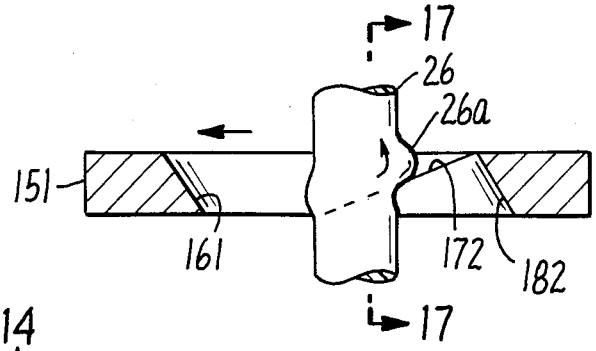
FIG. 16 is the same view as FIG. 14, showing a stud in the process of being headed.
Figure 13:
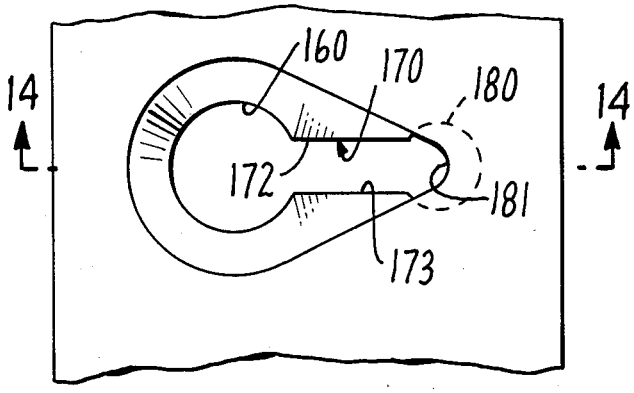
FIG. 13 is a plan view of the elements shown in FIG. 12.
Figure 17:
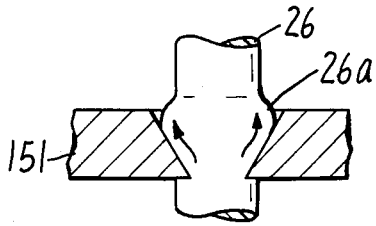
FIG. 17 is a section on the line 17—17 of FIG. 16.
Figure 14:
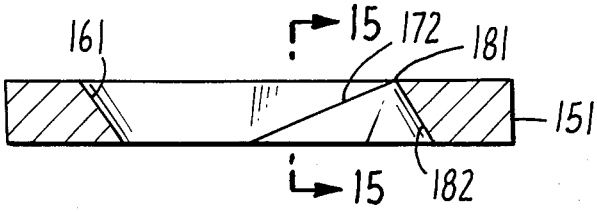
FIG. 14 is a section on the line 14—14 of FIG. 13.
Figure 15:
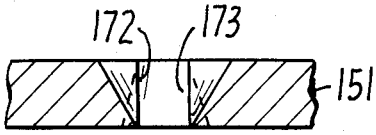
FIG. 15 is a section on the line 15—15 of FIG. 14.

Elongated portion 170 has a pair of inclined edges 172 and 173 that are inclined upwardly with respect to the direction in which blade means 150 is driven against stud 25. As plate 151 is driven to the left, as shown in FIG. 16, inclined edges 172 and 173 engage the shank 26 of stud 25 and form the bulge **26*a*. In this fashion edges 172 and 173 perform the "heading" operation as shown in FIGS. 16 and 17**.

Figure 18:
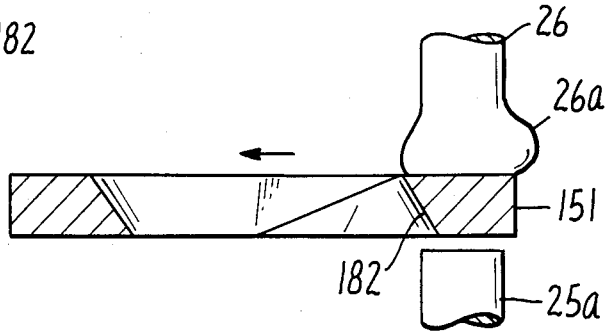
FIG. 18 is a sectional view showing the severing of the stud shown in FIG. 16.
Figure 19:
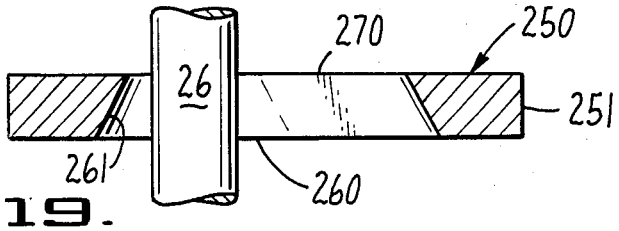
FIG. 19 is a side elevation, partly in section, of an alternate embodiment of the invention, at the beginning of its motion.

Cutoff portion 180 has a sharp arcuate cutting edge 181 formed in the upper surface of plate 151. Cutoff portion 180 also has a tapered surface 182 that diverges in a downward direction. As blade means 150 is driven to the left, as shown in FIG. 18, the lower portion 25a of stud 25 is severed by cutting edge 181.

Figure 20:
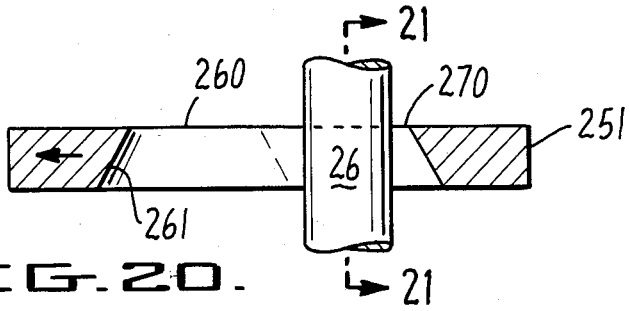
FIG. 20 is the same as FIG. 19 showing the second stage of the stroke.
Figure 21:
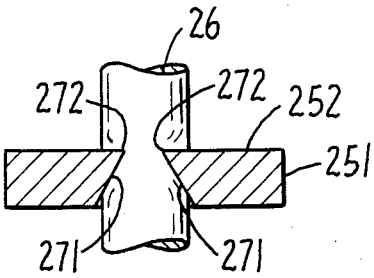
FIG. 21 is a section on the line 21—21 of FIG. 20.
Figure 22:
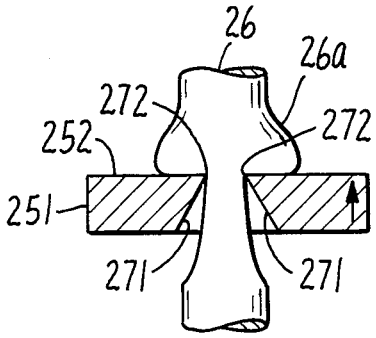
FIG. 22 shows the apparatus of FIG. 21 at the next phase of the stroke.
Figure 23:
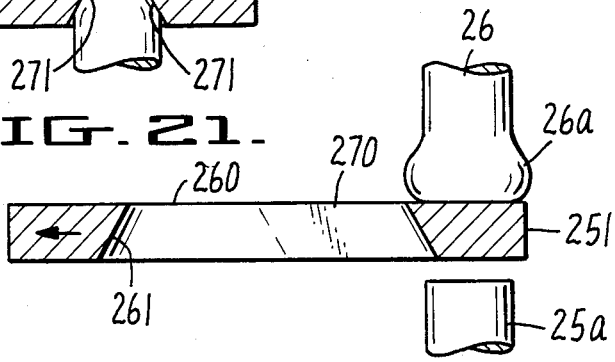
FIG. 23 shows the apparatus of FIGS. 19-22 at the end of the stroke.

FIGS. 19–23 show another embodiment of the invention. Knife means 250 comprises a flat plate 251 having a plurality of "keyhole" shaped openings formed therein. As shown in FIGS. 19–23, each opening has a circular section 260 with a tapered surface 261, and an elongated section 270 having tapered surfaces 271 and sharp cutting edges 272 which are parallel and lie on the upper surface 250 of plate 251. The heading operation in this embodiment is a two-step operation; in the first step the cutting edges 272 engage the shank 26 of stud 25 as shown in FIGS. 20 and 21 by the motion of knife means 250 in a direction (to the left) to engage stud 25; in the second step, the flat plate 252 is moved upwardly, forming bulge **26*a* which is driven into the countersunk portion 30 of the lower binding strip (not shown in FIGS. 19–23**).

Figure 24:
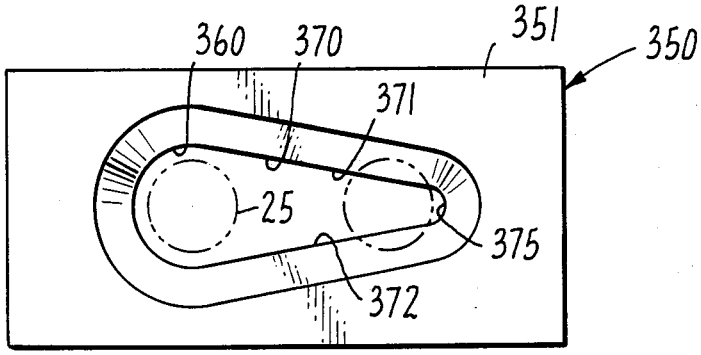
FIG. 24 is a plan view of another embodiment of the invention.

FIG. 24 represents a variation on the "keyhole" shape design within the scope of this invention. One part of the opening 360 is semi-circular, allowing for clearance relative to stud 25. The second part of the opening 370 is tapered in a converging fashion to a rounded vertex 375; the second part of the opening defines a pair of cutting edges 371 and 372 which engage the shank 26 of post 25 as plate 351 moves to the left. The shape of opening 370 is not critical; as long as it provides edges which are spaced apart a distance less than the diameter of post 25 and are adapted to form a bulge **26*a* in the shank 26 as the knife means 350 is moved to the left to engage the stud and then moved upwardly to head the shank of the stud. The V-shaped edges 371 and 372 could also be used on a "bent plate" as shown in FIGS. 4–11**.

I claim:

1. A binding system for forming a strip binding on a sheaf of papers comprising:

a. first binding strip means located on one side of said sheaf of papers including a plurality of thermoplastic studs extending therefrom, b. a sheaf of papers having a plurality of holes corresponding in number and placement to the number of studs of said first binding strip means, c. a second binding strip means located on the other side of said sheaf of papers comprising a backing member having a series of countersunk holes therethrough corresponding in number and placement to the number of studs on the first binding strip means, d. gripping means located on said other side of said sheaf of papers for grasping the protruding ends of said studs extending past said second binding strip means and pulling on said studs to compress said sheaf of papers, said gripping means being the sole means for compressing said sheaf of papers, e. heating means for heating the shanks of said studs whereby a bulge is formed within the countersunk portions of said second binding strip means, and f. knife means for severing the end of said studs flush with the said second binding strip means, and said knife means being located between said second binding strip and said gripping means such that the ends of said studs extend beyond said knife means.

2. A binding system for forming a strip binding on a sheaf of papers comprising:

a. first binding strip means located on one side of said sheaf of papers including a plurality of thermoplastic studs extending therefrom, b. a sheaf of papers having a plurality of holes corresponding in number and placement to the number of studs of said first binding strip means, c. a second binding strip means located on the other side of said sheaf of papers comprising a backing member having a series of countersunk holes therethrough corresponding in number and placement to the number of studs on the first binding strip means, d. gripping means located on said other side of said sheaf of papers for grasping the protruding ends of said studs extending past said second binding strip means and pulling on said studs to compress said sheaf of papers, said gripping means being the sole means for compressing said sheaf of papers, e. heading means for engaging the shanks of said studs and forming a bulge within the countersunk portions of said second binding strip means, f. heating means for heating said heading means, and g. knife means for severing the end of said studs flush with the said second binding strip means, and said knife means being located between said second binding strip and said gripping means such that the ends of said studs extend beyond said knife means.

3. The apparatus of claim 2 wherein said knife means comprises a plate with two horizontal sections joined by an inclined section and wherein a series of keyhole shaped openings are provided with a circular portion and an elongated portion and wherein said elongated portion has a pair of inclined edges which comprise said heading means and which heads said studs as said knife means is driven into engagement with said studs.

4. The apparatus of claim 2 wherein said knife means comprises a flat plate having a plurality of keyhole shaped openings formed therein, each having a circular portion and an elongated portion, and wherein each elongated portion has a pair of inclined edges which comprise said heading means and which heads said stud as said blade means is moved into engagement with said stud.

5. The apparatus of claim 2 wherein said knife means comprises a flat plate having a plurality of keyhole shaped openings formed therein, each of said openings having a pair of edges which comprise said heading means engaging the shanks of said studs, and whereby said shanks are headed as said flat plate moves upwardly.

* * * * *